US008584278B2

(12) United States Patent
Ross

(10) Patent No.: US 8,584,278 B2
(45) Date of Patent: Nov. 19, 2013

(54) SHEET SET FOR A SOFA

(76) Inventor: Monica Blake Ross, Sacramento, CA (US)

( * ) Notice: Subject to any disclaimer, the term of this patent is extended or adjusted under 35 U.S.C. 154(b) by 51 days.

(21) Appl. No.: 12/685,558

(22) Filed: Jan. 11, 2010

(65) Prior Publication Data

US 2010/0107336 A1 May 6, 2010

Related U.S. Application Data

(63) Continuation-in-part of application No. 11/725,010, filed on Mar. 16, 2007, now abandoned.

(60) Provisional application No. 60/783,336, filed on Mar. 17, 2006.

(51) Int. Cl.
*A47G 9/02* (2006.01)

(52) U.S. Cl.
USPC ..... 5/494; 5/498; 5/497; 297/228.1; 297/229

(58) Field of Classification Search
USPC ..... 5/494, 495, 498, 499, 482, 488, 497; 297/228, 228.1, 229
See application file for complete search history.

(56) References Cited

U.S. PATENT DOCUMENTS

| | | | | | |
|---|---|---|---|---|---|
| 3,340,969 | A * | 9/1967 | Rothberg | 190/1 |
| 5,321,862 | A * | 6/1994 | Campbell | 5/482 |
| 5,566,411 | A * | 10/1996 | Eiler | 5/494 |
| 5,702,038 | A * | 12/1997 | Miller et al. | 224/409 |
| 5,732,424 | A * | 3/1998 | Bond | 5/502 |
| 6,490,741 | B1 * | 12/2002 | Wheeler | 5/494 |
| 7,874,028 | B2 * | 1/2011 | Bradford | 5/502 |
| 2004/0033335 | A1 * | 2/2004 | Rueth | 428/92 |

* cited by examiner

*Primary Examiner* — Michael Trettel
(74) *Attorney, Agent, or Firm* — Kafantaris Law Offices; Theo Kafantaris

(57) ABSTRACT

A sofa sheet set for use with a sofa is disclosed. The sofa sheet set includes a bottom sheet that comprises a generally rectangular top portion and a peripheral side section, the side section having at a lower end thereof an embedded elastic band for capturing a plurality of sofa cushions. The sofa sheet set further includes a generally rectangular top sheet fixed at one of its long sides at a seam to one of the long sides of the bottom sheet. The top sheet is larger in length and width than the top portion of the bottom sheet. A handbag carrier is preferably included for containing and storing the bottom and top sheets in a folded configuration for convenient storage and transportation.

8 Claims, 2 Drawing Sheets

SHEET SET FOR A SOFA

CROSS REFERENCE TO OTHER APPLICATIONS

The present application is a continuation in part of application Ser. No. 11/725,110, now abandoned, which in turn claims the benefit of the Provisional Application Ser. No. 60/783,336 filed on Mar. 16, 2006.

FIELD OF THE INVENTION

This invention relates to bed sheets, and more particularly to a set of bed sheets adapted for use with a sofa or couch having a plurality of cushions.

DISCUSSION OF RELATED ART

It is necessary at times to utilize a sofa or couch as a bed. As a sofa cushions vary in size and may be thinner than even a twin size bed, traditional bed sheets are not easily adapted for use with a couch. Further, when sleeping on a couch with conventional bed sheets, the top sheet often falls away from the person sleeping on the couch due to the narrow width of the couch and because the top sheet and the bottom sheet are not connected to each other.

Therefore, there is a need for an inexpensive sofa sheet set for readily outfitting a sofa to accommodate a person for sleeping thereon. The design is intended to fit a variety of sofa cushion sizes, and would adapt to a wide variety of sizes of individuals. Another object of the present invention is to prevent the sheets from easily uncovering the sleeping person. The present invention accomplishes these objectives and is a substantially less expensive than purchasing a conventional sofa bed in which the sofa folds out to create a bed.

SUMMARY OF THE INVENTION

The present device is a set of sheets designed for use with a sofa or couch which are readily stored when not in use. The standard sofa is of the type having a plurality of bottom cushions and a backrest portion. The sofa sheet set includes a first or bottom sheet that comprises a generally rectangular upper portion. The upper portion of the bottom sheet includes a pair of opposing long sides and a pair of opposing short sides. A peripheral side section is formed around the sides of the rectangular upper portion of the bottom sheet at a top edge thereof. In the preferred embodiment, an elastic band is enclosed at the bottom edge of the peripheral side section. The bottom sheet is preferably fitted with the elastic or other means used to accommodate different sofa sizes.

The sofa sheet set further includes a generally rectangular second or top sheet, also having a pair of opposing long sides and a pair of opposing short sides. One of the long sides of the top sheet is continuously attached to one of the long sides of the bottom sheet, such as at a sewn seam. The top sheet at least partially overlaps the top portion of the bottom sheet. The long sides of the top sheet are longer than the long sides of the bottom sheet, and preferably the short sides of the top sheet are longer than the short sides of the bottom sheet.

A handbag carrier is preferably included for containing and storing the bottom and top sheets in a folded configuration. The handbag carrier ideally includes a zippered closure and at least one handle for easy carrying thereof. The handbag carrier, with the folded bottom and top sheets therein, may be easily stored in a hallway closet or the like.

The present invention is a sofa sheet set for quickly outfitting a sofa to accommodate a person for sleeping thereon. The present invention fits a variety of couch cushion sizes, and adapts to a wide variety of individual sizes.

The present invention allows a sleeping person to remain covered during sleep, without the top sheet falling away from the sleeping person as the sleeper moves during the night. The present invention is designed such that the long side of the bottom sheet is shorter than the long side of the top sheet. The long side of the top sheet extends past the long side of the bottom sheet and the long side of the top sheet is secured perpendicularly to the short side of the bottom sheet. The first long side of the top sheet is attached only to the first long side of the bottom sheet forming a continuous seam which is perpendicular to the short sides of the sheets. The long side of the bottom sheet is centered relative to the (longer) first opposing long side of the top sheet. The afore-described configuration of the top sheet relative to the bottom sheet keeps the user covered with the top sheet and serves to prevent the top sheet from falling away from the sofa as often happens when one attempts to use a conventional set of sheets on a sofa. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 2:
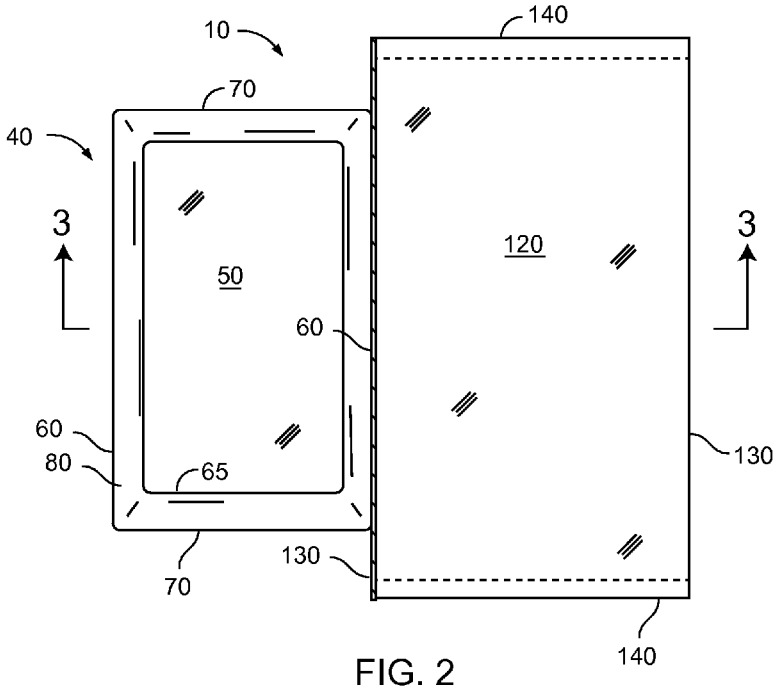
FIG. 2 is a bottom plan view of the invention, illustrating a top sheet folded away from a bottom sheet.
Figure 3:
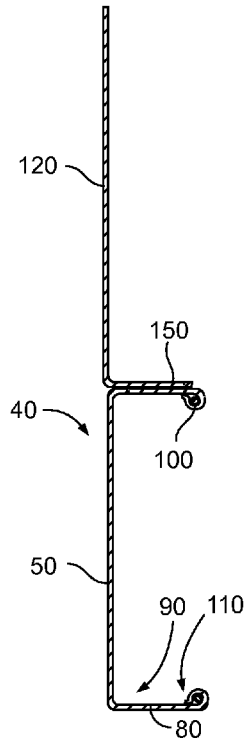
FIG. 3 is a cross-sectional view of the invention, taken generally along lines 3-3 of FIG. 2.
Figure 1:
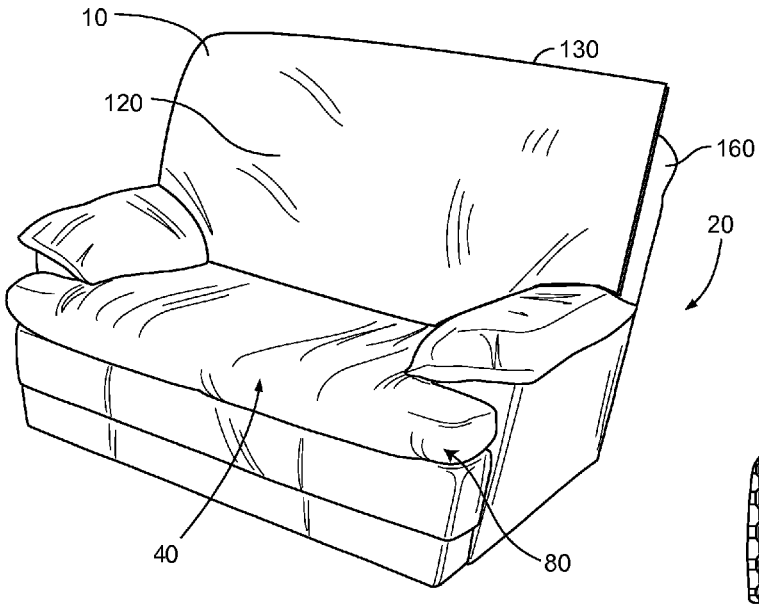
FIG. 1 is a perspective view of the invention, illustrating the sofa sheet set in use with a sofa.

FIG. 1 illustrates a sofa sheet set 10 as used with a sofa 20. The sofa 20 is of the type having a plurality of bottom cushions and a backrest portion 160. FIG. 2 illustrates the sofa sheet set 10 in an unfolded configuration, without the sofa 20.

The sofa sheet set 10 includes a bottom sheet 40 and a top sheet 120. The bottom sheet 40 includes a pair of opposing long sides 60 and a pair of opposing short sides 70. In the preferred embodiment, the bottom sheet 40 is a fitted sheet which has a central portion 50 and a peripheral side section 80. The peripheral side section 80 is formed around the sides of the rectangular central portion 50 of the bottom sheet 40. The peripheral side section 80 forms a loop or hem from the top edge 90 to the bottom edge 110. The hem encloses an elastic band 100. The elastic band 100 has a length of less than the two long sides 60 plus the two short sides 70 of the bottom sheet 40 and permits the bottom sheet to fit around different sized sofa cushions. Other ways of varying the size the bottom sheet to enclose the sheet around the couch cushions may be used e.g. drawstrings. As such, the bottom sheet 40 is well suited for fitting around a plurality of varying sofa cushions, forming an edge 65 (FIG. 2) and capturing the cushions therein. Preferably, the bottom and top sheets are integrally formed of cotton, polyester, or other suitable blends and materials.

The sofa sheet set 10 further includes a generally rectangular top sheet 120 having a pair of opposing long sides 130 and a pair of opposing short sides 140. One of the long sides 130 of the top sheet 120 is attached to one of the long sides 60 of the bottom sheet. The sheets may be attached forming a continuous seam in a variety of ways: they may be sown together forming a seam 150, they may be attached using hook-and-loop material [Velcro®], and the like. In forming the seam, a portion of the top sheet 120 may partially overlap a portion of the bottom sheet 40. Preferably, the long sides 130 of the top sheet 120 are longer than the long sides 60 of the bottom sheet 40, and preferably the short sides 140 of the top sheet 120 are longer than the short sides 70 of the bottom sheet 40. As such, the top sheet 120 is well-suited for covering a person sleeping between the top sheet 120 and the bottom sheet 40 on the sofa 20.

Figure 4:
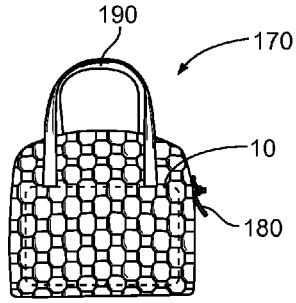
FIG. 4 is a handbag carrier for the sofa sheet set.

A handbag carrier 170 (FIG. 4) is preferably included for containing and storing the bottom and top sheets 40, 120 in a folded configuration (not shown). The handbag carrier 170 ideally includes a zippered closure 180 and at least one handle 191 for transporting the package e.g. when traveling. The handbag carrier 170, with the folded bottom and top sheets 40, 120 therein, may be easily stored in a hallway closet or the like. Preferably the handbag carrier 170 includes space therein for a pillowcase, bottom sheet 40 and top sheet 120. The sheets and the handbag carrier 170 may have a matching fabric patterns.

In use, the handbag carrier 170 is opened and the folded bottom and top sheets 40, 120 are removed therefrom. The bottom sheet 40 is unfolded and placed over one, two, or more cushions 30 of the sofa 20 as appropriate, with the seam 150 oriented towards the back of the sofa 20. An individual (not shown) may then repose on the bottom sheet 40 with the top sheet 120 over the individual. As the individual tosses and turns during sleep, the seam 150 and the larger size of the top sheet 120 compared with the bottom sheet 40 will help to maintain the top sheet 120 covering the individual.

Figure 5:
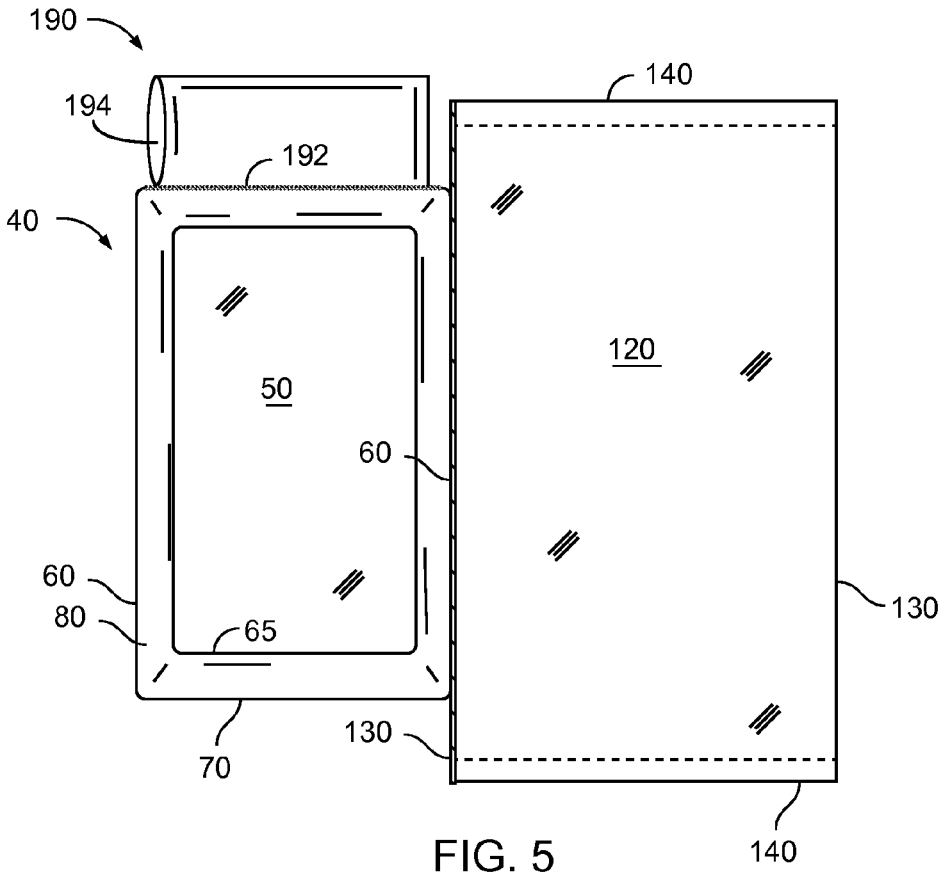
FIG. 5 is plan view of a preferred embodiment of the invention showing a pillow case removeably affixed to the bottom sheet.
Figure 6:
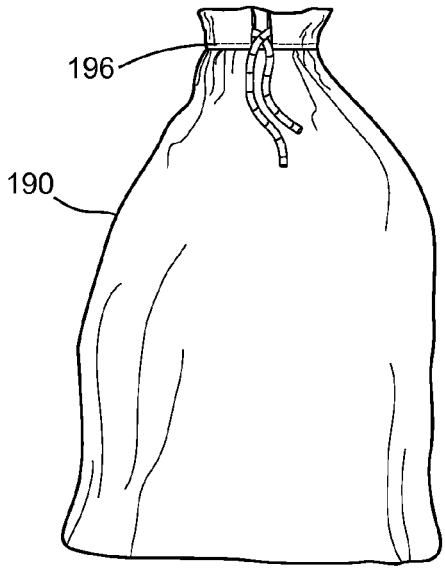
FIG. 6 is a view of the pillow case used a carrying bag for the sofa sheet set.

In another preferred embodiment, shown in FIG. 5, a pillow case 190 is provided to receive a pillow through its opening 194. The pillow case 190 is removeably attached to the bottom sheet with, e.g. hook and loop material (Velcro®), at the upper portion 192 of the bottom sheet 40. Thus, the pillow and pillow case are secured with the sheets so that the components of the sofa sheet kit will be kept together. The pillow case 190 may further include a drawstring 196 sewn under the hem of the pillow case. The pillow case 190 may therefore also be used as a carrying bag for receiving the top and bottom sheets and closed and carried with the drawstring 196 or other suitable handle and/or closing mechanism.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A sofa sheet set for use by a reclining user with a sofa having a backrest generally perpendicular to a plurality of bottom cushions, comprising:

a bottom sheet having first and second opposing long sides and first and second opposing short sides; and a generally rectangular top sheet having first and second opposing long sides and first and second opposing short sides, wherein: (a) the length of said first and second opposing long sides of said top sheet is greater than the length of said first and second opposing long sides of said bottom sheet, (b) the length of said first and second opposing short sides of said top sheet is greater than the length of said first and second opposing short sides of said bottom sheet, (c) said first long side of said top sheet is attached only to said first long side of said bottom sheet forming a continuous seam wherein said first short side of said bottom sheet forms a connected intersection with said first long side of said top sheet, (d) said opposing first long side of said top sheet extends beyond said first short side of said bottom sheet and form a 90 degree angle at the connected intersection of said first long side of said top sheet and said first short side of said bottom sheet and wherein said bottom sheet is adapted to surround the plurality of bottom cushions of the sofa (e) such that said seam may be positioned at the intersection of the backrest of the sofa and the cushions and (f) wherein said first opposing long side of said top sheet is centered relative to said first opposing long side of said bottom sheet.

2. The sofa sheet set of claim 1, wherein said bottom sheet further includes a hem formed around said first and second long sides and said first and second short sides, and a sizing means enclosed within said peripheral side section.

3. The sofa sheet set of claim 1, further including a handbag carrier for containing the bottom sheet and top sheet when the bottom sheet and the top sheet are in a folded configuration.

4. The sofa sheet set of claim 3 further wherein said handbag carrier includes a zippered closure and at least one handle.

5. The sofa sheet set of claim 1 further wherein said long side of said top sheet at least partially overlaps said long side of said bottom sheet in plan view.

6. The sofa sheet set of claim 1 wherein said first long side of said bottom sheet is removeably affixed to one of said long sides of said top sheet.

7. The sofa sheet set of claim 1 wherein the length of said opposing first and second long sides of said bottom sheet is shorter than the length of said first and second opposing long sides of said top sheet.

8. The sofa sheet set of claim 2, further including a handbag carrier for containing the bottom sheet and top sheet when the bottom sheet and the top sheet are in a folded configuration.

* * * * *